United States Patent [19]

Ciccarello

[11] 4,008,593

[45] Feb. 22, 1977

[54] DEVICE FOR SPINNING OF METAL OBJECTS

[76] Inventor: Richard L. Ciccarello, 7 Park Ave., Glen Cove, N.Y. 11542

[22] Filed: June 27, 1975

[21] Appl. No.: 590,965

[52] U.S. Cl. ..... 72/75; 72/82; 72/480

[51] Int. Cl.[2] ..... B21D 22/16

[58] Field of Search ..... 72/75, 83, 480, 82

[56] References Cited

UNITED STATES PATENTS

| | | | |
|---|---|---|---|
| 1,240,791 | 9/1917 | Czajka | 72/75 |
| 2,048,598 | 7/1936 | Christiansen | 72/75 |
| 2,245,806 | 6/1941 | Oeckl et al. | 72/480 |
| 2,732,743 | 1/1956 | Hart | 72/480 |
| 3,434,321 | 3/1969 | Morgan | 72/83 |

FOREIGN PATENTS OR APPLICATIONS

| | | | |
|---|---|---|---|
| 6,557 | 1834 | United Kingdom | 72/82 |

*Primary Examiner*—Lowell A. Larson
*Attorney, Agent, or Firm*—Frank Makara

[57] ABSTRACT

This device relates to a device or tool for pressing sheet metal toward and to engage a spinning or rotating cylindrical-like mold to forceably deform the metal to assume the shape of said mold. More particularly, it relates to an improved device having a freely rollable or universal ball captively held in a ball bearing racer and thereby effect a substantially frictionless inward movement of said sheet metal against said pressure deforming universally rollable ball.

1 Claim, 5 Drawing Figures

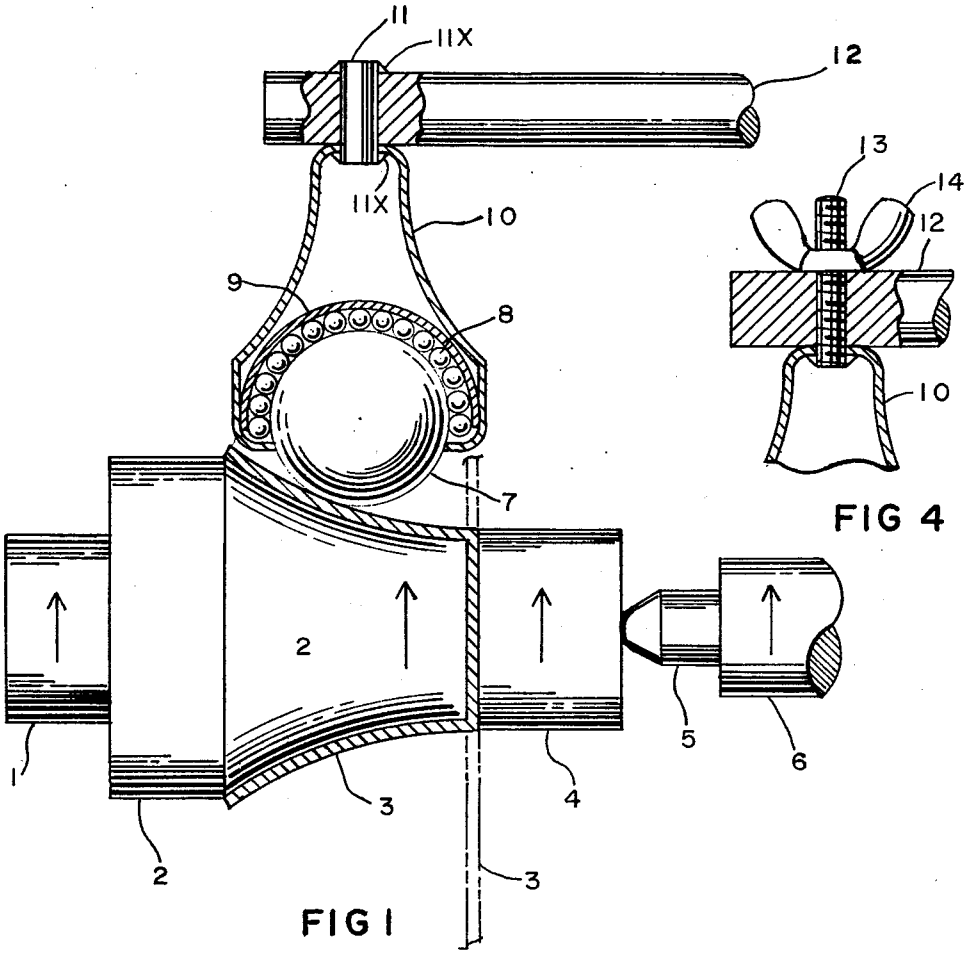
FIG 1
FIG 4
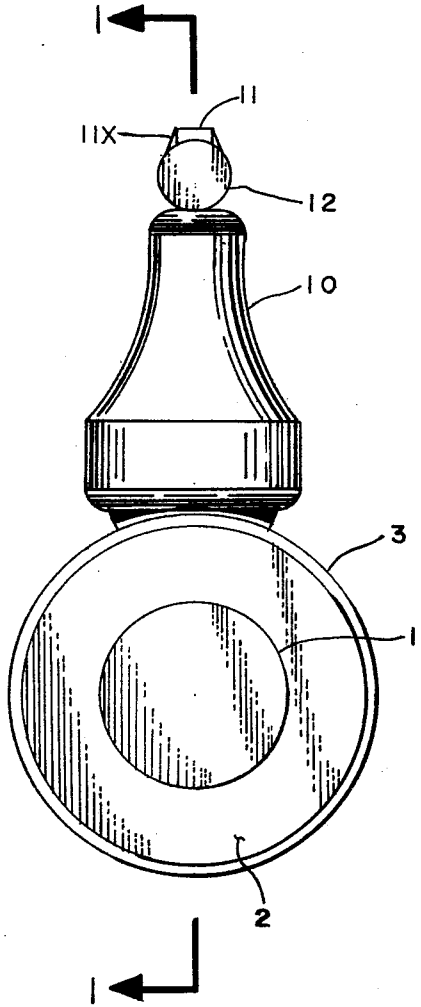
FIG 2

DEVICE FOR SPINNING OF METAL OBJECTS

In the prior art, a handle operated tool having a hemisherical metal end is used. This tool has no rotatable or moving parts, so that there is a rubbing-sliding friction-producing engagement between the deforming knob-end and sheet metal. To reduce this friction, beeswax is employed, since a liquid lubricant applied to the swiftly rotating sheet metal flys off the metal and into the atmosphere.

In the device of this invention, no lubricant is needed or desired.

It is an object of this invention to provide a lubricant-free spinning tool that produces a substantially frictionless rolling deforming contact pressure against a rotating sheet of metal.

It is another object to provide a metal spinning tool of inexpensive construction and long life, and having a freely rolling ball therein for producing the necessary deforming contact to rotating sheet metal.

These and other objects will become apparent upon reading the descriptive disclosure herein of a plurality of embodiments of this invention as shown in the accompanying drawing, in which FIG. 1 is a side view, partly in section, showing the device applied to a flared vase, and taken substantially on line 1—1 of FIG. 2;

FIG. 2 is an end view of the device of FIG. 1;

FIG. 4 shows a modified device wherein the ball containing element is removably disposed for easy replacement when worn out and when balls of different diameter are desired.

Figure 5:
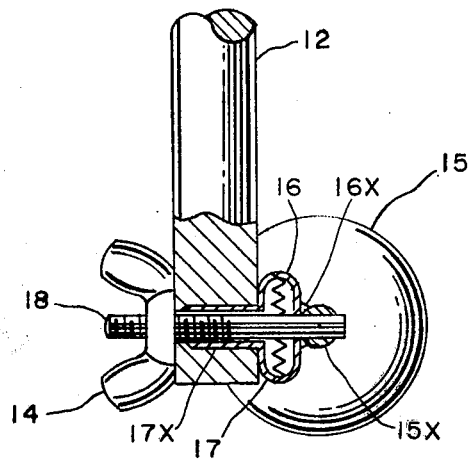
FIG. 5 is a section view taken on line 5—5 of FIG. 3 showing the means for selective rotation and locking of the ball element to the handle element.

As a statement of the invention, the device herein employes a freely rollable deform - producing ball, which ball is held captively against ball bearings to produce a ball assembly element. This ball element is secured fixedly or removably to an elongated handle element suitably and critically close to the end thereof.

Turning now to the drawing and FIG. 1 thereof, a mold 2 made of wood, plastic or other material is pressure seized to a sheet of metal to be formed into an object having the outer contour configuration of said mold. The metal may be of aluminum or other metal of suitable thickness as to be deformed by suitable pressure. The mold 2 is pressure seized to a front holder block which in turn is seized to a latheshaft (not shown, but like the rear lathe elements 5 and 6). Holder block 4 seizes the metal sheet 3 to the mold 2, and is in turn seized by the lathe pointed end element secured to lath shaft 6. In other words, elements 1,2,3 and 4 are disposed between the rotating lathe shafts and rotate as an integral unit.

The device of this invention, in one embodiment, is shown in FIG. 1 by means of elements 7 to 12. The elements 7,8,9 and 10 are purchaseable as a unit as casters in the furniture trade. These casters include a bell housing 10 captively retaining a hemispherical racer element 9 therein with its plurality of ball bearings 8 engaging a protruding ball of large diameter 7 locked below its diameter to housing 10.

The manner of securing the bell housing to the handle 12 may be varied. In FIG. 1 a rod 11 is welded to the metal handle 12 at weld spots 11X.

FIG. 4 shows a modified means of removably securing the housing 10 to the rod 12, wherein a screw-threaded stud 13 is welded to the housing 10 and then disposed in a suitable aperture suitably located near the end of rod 12. A wing nut 14 is threaded onto the stud 13 to lock the housing to said handle.

Figure 3:
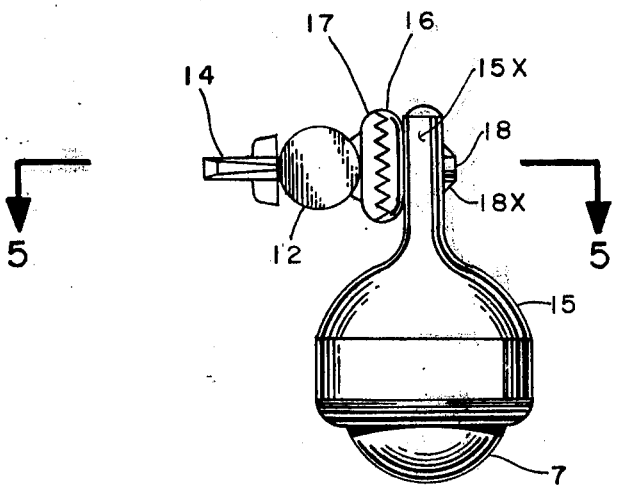
FIG. 3 is an end view of a modified device, showing means for selectively rotating and locking the ball containing element relative to the handle element.

FIGS. 3 and 5 show a modified form of the invention wherein a modified housing 15 may be swung about the axis of rod 18 vertical to the axis of the rod 12, to select a suitable angle and thereafter secured to said rod 12. In this modification, the housing 15 is provided with an elongated apertured neck portion 15X. A conventional two-piece serrated teeth locking device comprising a circular toothed element 16 and a co-acting toothed element 17 is used.

Element 16 is fixedly secured to housing portion 15X by weld spots 16X. Element 17 is provided with a tubular extension section 17X press fitted into the aperture of rod 12, suitably away from the end thereof. A partly threaded rod 18 is fixedly secured to housing neck portion 15X by weld spots 18X so that serrated element 16 rotates with said housing as a unit. Rod 18 is inserted through tube 17X to protrude beyond the rod 12 cylindrical surface. A wing nut 14 is used to lock the handle rod assembly unit to removable and rotatable bell housing assembly unit. Thus the housing unit may be rotated and then secured to the rod assembly unit at other angles then the right angle position shown in FIGS. 3 and 5.

In the operation of the device, the ball 7 engages the flat sheet metal 3 adjacent to block 4 and is pushed toward the mold 2 and toward block 1 simultaneously, to deform the metal and thereby assume a surface contact with the surface of the mold 2, as shown in FIG. 1.

I claim:

1. As an article of manufacture, a hand held individually operated tool for selectively spinning a metal sheet into curved artistic objects consisting essentially of a longitudinal handle having an aperture at a right angle to the handle axis in suitable spaced relationship to an end thereof; a ball assembly consisting of a large metal hard ball having an exposed portion for contacting said metal sheet while spinning, a housing captively retaining said hard ball with an exposed ball surface and having an apertured neck portion disposed away from said exposed surface, a plurality of ball bearings disposed in said housing captively between said hard ball and the housing wall, a rod fixedly secured to said neck portion and passing through its aperture at a right angle, said rod having a threaded portion at the unsecured end thereof; a first disc having a serrated teeth face and secured fixedly upon and to said rod adjacent to said neck housing portion; a second serrated disc adapted to co-act with said first disc in selective locked serrated relationship and having a tubular portion for slidably engaging said rod in the handle aperture; and threaded nut means for engaging the threaded rod end extending through said handle aperture whereby the hard ball retaining housing is selectively rotated through a suitable arc at a right angle to the handle axis and thereafter locked in serrated teeth relationship for artistically deforming said sheet metal.

* * * * *